US010211535B2

(12) United States Patent
Rahmat-Samii et al.

(10) Patent No.: US 10,211,535 B2
(45) Date of Patent: Feb. 19, 2019

(54) LOW-PROFILE CIRCULARLY-POLARIZED SINGLE-PROBE BROADBAND ANTENNA

(71) Applicant: The Regents of the University of California, Oakland, CA (US)

(72) Inventors: Yahya Rahmat-Samii, Los Angeles, CA (US); Harish Rajagopalan, Los Angeles, CA (US); Joshua M. Kovitz, Los Angeles, CA (US); Jean Paul Santos, Los Angeles, CA (US)

(73) Assignee: The Regents of the University of California, Oakland, CA (US)

( * ) Notice: Subject to any disclaimer, the term of this patent is extended or adjusted under 35 U.S.C. 154(b) by 164 days.

(21) Appl. No.: 15/214,892

(22) Filed: Jul. 20, 2016

(65) Prior Publication Data

US 2017/0025762 A1 Jan. 26, 2017

Related U.S. Application Data

(60) Provisional application No. 62/194,584, filed on Jul. 20, 2015.

(51) Int. Cl.
*H01Q 9/04* (2006.01)
*H01Q 1/48* (2006.01)
*H01Q 13/10* (2006.01)

(52) U.S. Cl.
CPC ..... *H01Q 9/0428* (2013.01); *H01Q 1/48* (2013.01); *H01Q 9/045* (2013.01); *H01Q 9/0442* (2013.01); *H01Q 13/106* (2013.01)

(58) Field of Classification Search
CPC .... H01Q 9/0428; H01Q 9/045; H01Q 9/0442; H01Q 1/48; H01Q 9/0407; H01Q 13/106
(Continued)

(56) References Cited

U.S. PATENT DOCUMENTS 5,815,119 A * 9/1998 Helms ..... H01Q 5/40 343/700 MS
5,861,848 A * 1/1999 Iwasaki ..... H01Q 9/0407 343/700 MS (Continued)

FOREIGN PATENT DOCUMENTS

JP 2012049732 A 3/2012
WO 2017015339 1/2017

OTHER PUBLICATIONS

International Preliminary Report on Patentability for International Application PCT/US2016/043089, Report dated Jan. 23, 2018, dated Feb. 1, 2018, 6 Pgs.

(Continued)

*Primary Examiner* — Brian Young
(74) *Attorney, Agent, or Firm* — KPPB LLP

(57) ABSTRACT

Low-profile broadband patch antennas capable of radiating circularly polarized (CP) signals utilizing a single probe in accordance with embodiments of the invention are disclosed. In many embodiments, the patch antenna includes a ground plane, a patch plate, at least one dielectric or foam substrate, and a feed probe. In several embodiments, the patch plate includes a first plate and a second plate that can be connected via first and second connecting bars. In various embodiments, the connection of the first and second plates can expose first and second slots as further discussed below. In a variety of embodiments, the feed probe can be a coaxial cable having an inner and outer conductor where the inner conductor connects to the first plate and the outer conductor connects to the ground plane.

10 Claims, 9 Drawing Sheets

(58) Field of Classification Search
USPC ..... 343/700 MS
See application file for complete search history.

(56) References Cited

U.S. PATENT DOCUMENTS

| | | | | |
|---|---|---|---|---|
| 6,424,299 | B1 * | 7/2002 | Cha | H01Q 9/0435 343/700 MS |
| 6,606,061 | B2 * | 8/2003 | Wong | H01Q 1/38 343/700 MS |
| 7,042,403 | B2 | 5/2006 | Colburn et al. | |
| 9,941,577 | B2 * | 4/2018 | Kim | H01Q 15/0086 |
| 2009/0153404 | A1 | 6/2009 | Ryou et al. | |
| 2011/0148722 | A1 | 6/2011 | Bellows | |
| 2012/0319922 | A1 | 12/2012 | Fuchs et al. | |
| 2014/0145891 | A1 | 5/2014 | Palevsky et al. | |

OTHER PUBLICATIONS

Chair et al., "Miniature wide-band half U-slot and half E-shaped patch antennas", IEEE Transactions on Antennas and Propagation, vol. 53, Issue 8, Aug. 8, 2005, pp. 2645-2652, DOI: 10.1109/TAP.2005.851852.

Khidre et al., "Wideband Circularly Polarized E-Shaped Patch Antenna for Wireless Applications", IEEE Antennas and Propagation Magazine, vol. 52, Issue 5, Oct. 2010, pp. 219-229, DOI: 10.1109/MAP.2010.5687547.

Kovitz et al., "Understanding the radiation pattern anomalies in the broadband CP reconfigurable E-shaped patch", 2014 IEEE Antennas and Propagation Society International Symposium (APSURSI), Jul. 6-11, 2014, pp. 1580-1581, DOI: 10.1109/APS.2014.6905116.

Kovitz et al., "Using Thick Substrates and Capacitive Probe Compensation to Enhance the Bandwidth of Traditional CP Patch Antennas", IEEE Transactions on Antennas and Propagation, vol. 62, Issue 10, Oct. 2014, pp. 4970-4979, Date of Publication Jul. 25, 2014, DOI: 10.1109/TAP.2014.2343239.

Rahmat-Samii et al., "Nature-Inspired Optimization Techniques in Communication Antenna Designs", Proceedings of the IEEE, vol. 100, Issue 7, Jul. 2012, pp. 2132-2144, Date of Publication May 24, 2012, DOI: 10.1109/JPROC.2012.2188489.

Sharma et al., "Analysis and optimized design of single feed circularly polarized microstrip antennas", IEEE Transactions on Antennas and Propagation, vol. 31, Issue 6, Nov. 1983, pp. 949-955, DOI: 10.1109/TAP.1983.1143162.

Yang et al., "Wide-band E-shaped patch antennas for wireless communications", IEEE Transactions on Antennas and Propagation, vol. 49, Issue 7, Jul. 2001, pp. 1094-1100, DOI: 10.1109/8.933489.

* cited by examiner

80

85

LOW-PROFILE CIRCULARLY-POLARIZED SINGLE-PROBE BROADBAND ANTENNA

CROSS-REFERENCE TO RELATED APPLICATIONS

This application claims priority to U.S. Provisional Patent Application No. 62/194,584 entitled "Low-Profile Circularly Polarized Single-Probe Broadband Antenna", filed Jul. 20, 2015, the disclosure of which is incorporated herein by reference in its entirety.

FIELD OF THE INVENTION

The present invention generally relates to antennas and more specifically to low-profile broadband patch antennas capable of radiating circularly polarized signals utilizing a single probe feed.

BACKGROUND

Circularly polarized (CP) patch antennas suffer from narrow bandwidths due to their inability to use electrically thick substrates. Typically, the probe reactance becomes too great at frequencies with good axial ratio (AR), thus rendering the S11 performance inadequate for most applications. Further, enabling thick substrates for this class of patch antenna can necessitate structural modifications to remove the reactance associated with the probe feed. Although planar capacitive compensation using annular gaps may provide the necessary capacitance, planar capacitors call for very small gaps which can be challenging to implement.

SUMMARY OF THE INVENTION

Systems and methods for implementing a circularly polarized patch antenna in accordance with embodiments of the invention are disclosed. In one embodiment, a circularly polarized patch antenna includes a ground plane, a patch plate that includes a first plate and a second plate, where the first and second plates are connected via a first connecting bar and a second connecting bar, and the connection between the first and second plates via the first and second connecting bars exposes a first slot and a second slot, at least one dielectric substrate that separates the ground plane and the patch plate, a feed probe including an inner conduct and an outer conductor where the inner conductor is connected to the first plate and the outer conductor is connected to the ground plane, where the broadband patch antenna is configured to radiate a circularly polarized radio frequency (RF) signal.

In a further embodiment, the second slot has a length that is longer than the length of the first slot.

In another embodiment, the second connecting bar separates the first and second slots.

In a still further embodiment, the first and second connecting bars are equal in shape.

In a still another embodiment, the first and second connecting bars are not equal in shape.

In a yet further embodiment, the circularly polarized RF signal is left-hand polarized.

In a yet another embodiment, the circularly polarized RF signal is right-hand polarized.

In a further embodiment again, the feed probe is a coaxial cable.

In another embodiment again, the at least one dielectric substrate is a foam substrate.

In another additional embodiment, the at least one dielectric substrate is a substrate that enhances mechanical and electrical performance characteristics of the broadband patch antenna.

In a still yet further embodiment, the circularly polarized RF signal is transmitted with a radiation pattern that is unidirectional towards broadside.

DETAILED DESCRIPTION OF THE DRAWINGS

Figure 1:
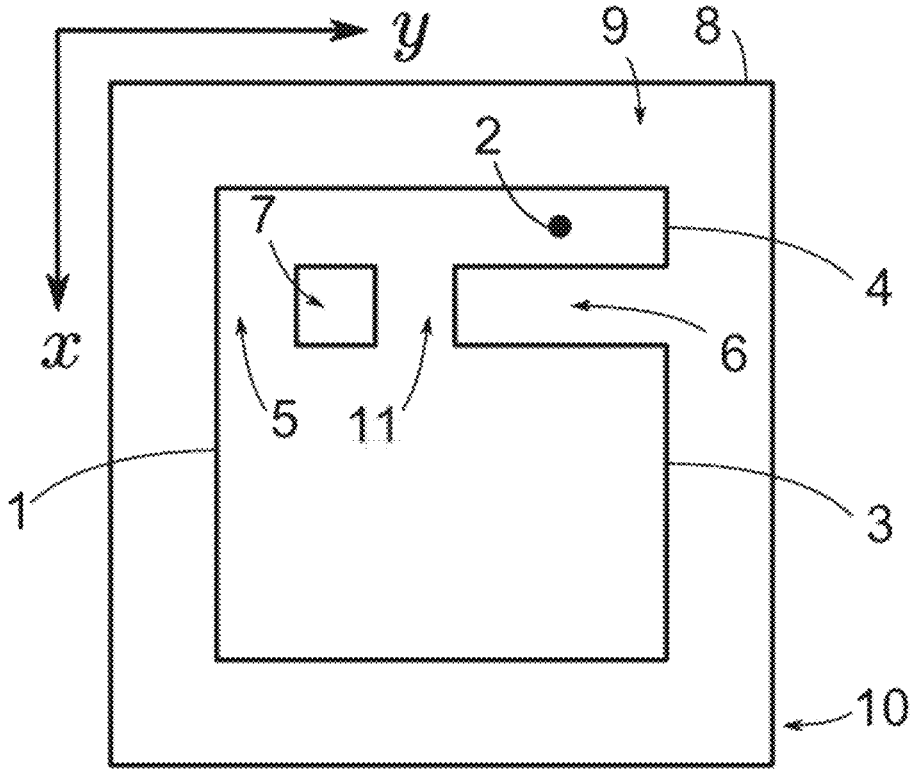
FIG. 1 is a top side view diagram illustrating a right-hand circularly polarized (RHCP) patch antenna in accordance with an embodiment of the invention.

Turning now to the drawings, low-profile broadband patch antennas capable of radiating circularly polarized (CP) signals utilizing a single probe in accordance with embodiments of the invention are disclosed. In many embodiments, the patch antenna includes a ground plane, a patch plate, at least one dielectric or foam substrate, and a feed probe. In several embodiments, the patch plate includes a first plate and a second plate that can be connected via first and second connecting bars. In various embodiments, the connection of the first and second plates can expose first and second slots as further discussed below. In a variety of embodiments, the feed probe can be a coaxial cable having an inner and outer conductor where the inner conductor connects to the first plate and the outer conductor connects to the ground plane.

The design of the patch plate can determine the polarization of the radio frequency (RF) signal (and propagation characteristics) where the circular polarization can be created by properly tuning the length and width of the second plate and the location of the first and second connecting bars in relation to the first plate. In many embodiments, the first plate and the connecting bars provide reactive compensation for a coaxial probe inductance when the patch plate is located at electrically thick distances from the ground plane. Typically, the thick substrate allows for broad bandwidth, and the reactive compensation can improve the impedance matching performance. With improved performance, better signal strength can be realized for both transmission and reception. CP patch antennas in accordance with embodiments of the invention are discussed further below.

Circularly Polarized (CP) Patch Antennas

Circular polarized patch antennas in accordance with many embodiments of the invention may be used in various applications, including global positioning systems (GPS), handheld to satellite communications, direct broadcast satellite (DBS), space communications, and radio frequency identification (RFID), among various other applications that utilize circular polarization, and the CP patch antenna design may provide many attractive features for these applications and systems. Some benefits from CP patch antennas in accordance with several embodiments of the invention include a low-profile conformability and ability to receive a strong signal independent of the polarization orientation of the received signal. In many embodiments, at certain frequencies, CP communication utilizing a CP patch antenna may also overcome the Faraday rotation effect, which describes the effect of having a signal rotated in space which may cause the signal strength to be weakened. Accordingly, many features of the CP patch antenna in accordance with many embodiments of the invention may strongly benefit aircraft, spacecraft, missiles, and other vehicles requiring high-performance avionics. CP patch antennas in accordance with many embodiments of the invention may also be utilized for backhaul networks in WiFi Onboard airplane systems. Many other potential applications may benefit from the CP patch antenna design, while providing a cost effective and high performance solution as required by specific applications in accordance with many embodiments of the invention.

Broadband, low-profile patch antennas can produce radiation patterns that are unidirectional towards broadside and either right-hand or left-hand circular polarized. In many embodiments, the RF signals are right-handed if the second plate is fed from the top and left-handed if the second plate is fed from the bottom. Circularly-polarized signals can be ideal for bandwidth limited systems such as (but not limited to) satellite communication systems whether left-hand and right-hand polarization can double the amount of information that can be transmitted in a particular bandwidth. Further, the feature sizes of the antennas in accordance with embodiments of the invention can be ideal for the transmission/reception of RF signals in the microwave and millimeter-wave bands.

A top side view of a RHCP patch antenna in accordance with an embodiment of the invention is illustrated in FIG. 1. The antenna 10 includes a patch plate 1 that is located a distance above a ground plane 8. The patch plate 1 can include a first plate 4, a second plate 3, and two connecting bars 5, 11 joining the first and second plates. In operation, the first plate 4, the second plate 3, and the connecting bars 5, 11 can be tuned to resonate at the desired frequency. In many embodiments, the patch plate 1 can be a single piece of conductive metal chosen from metals that are known to one of ordinary skill in the art. Further, the ground plane 8 can also be a conductive metal known to one of ordinary skill in the art. In various embodiments, the patch plate 1 can be suspended above an air substrate, or may be patterned on to a top substrate 9 as further discussed below. In various embodiments, the connection of the first and second plates exposes a first 7 and a second slot 6 where the length of the second slot 6 can be greater than the length of the first slot 7. As illustrated, the first and second slots can each have pairs of sides of equal length. In many embodiments, an inner conductor of a coaxial probe feed 2 can be connected to the first plate 4.

Figure 2:
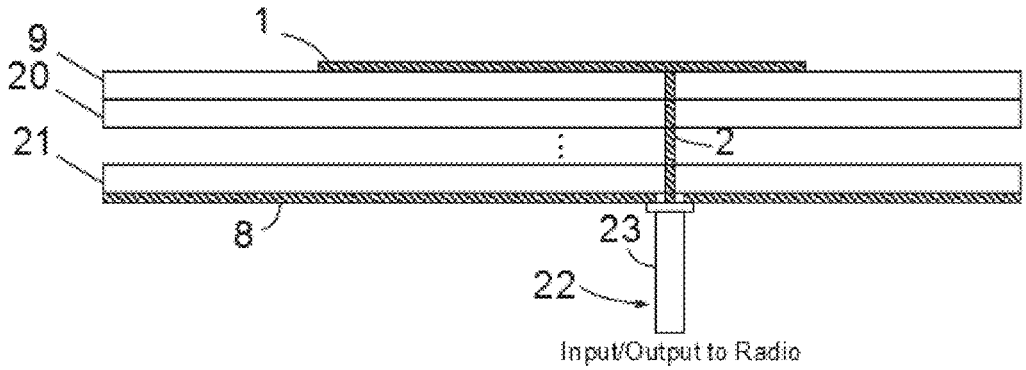
FIG. 2 is a profile side view diagram illustrating a patch antenna in accordance with an embodiment of the invention.

A profile side view of a RHCP patch antenna in accordance with an embodiment of the invention is illustrated in FIG. 2. In various embodiments, the patch antenna can be fed by a coaxial cable 22 that is connected to a radio. The cable 22 can include an inner conductor 2 and an outer metal jacket (i.e. an outer conductor) 23. The inner conductor 2 can be connected to the first plate of the patch plate as described above. Further, the outer metal jacket 23 can be connected to the ground plane 8. In various embodiments, the cable 22 excites the patch plate 1 with respect to the ground plane 8 to transmit and/or receive RF signals. Thus, the patch antenna 10 can be configured to transmit and/or receive circularly polarized signals at resonant frequencies. Multiple substrates 9, 20, 21 may be placed underneath the patch plate 1 to enhance mechanical and/or electrical performance characteristics in a manner well known to one of ordinary skill in the art. The patch design can be implemented utilizing a single metallization-patterned layer and a single probe feed, lowering fabrication cost and complexities. In many embodiments, the first and second slots are of reasonable size compared to the overall size of the antenna. This enables fabrication at higher frequencies, where small gaps can be an issue in fabrication. Although a specific RHCP patch antenna is discussed above with respect to FIG. 2, any of a variety of CP patch antennas including LHCP patch antennas can be likewise configured in accordance with embodiments of the invention.

Figure 3:
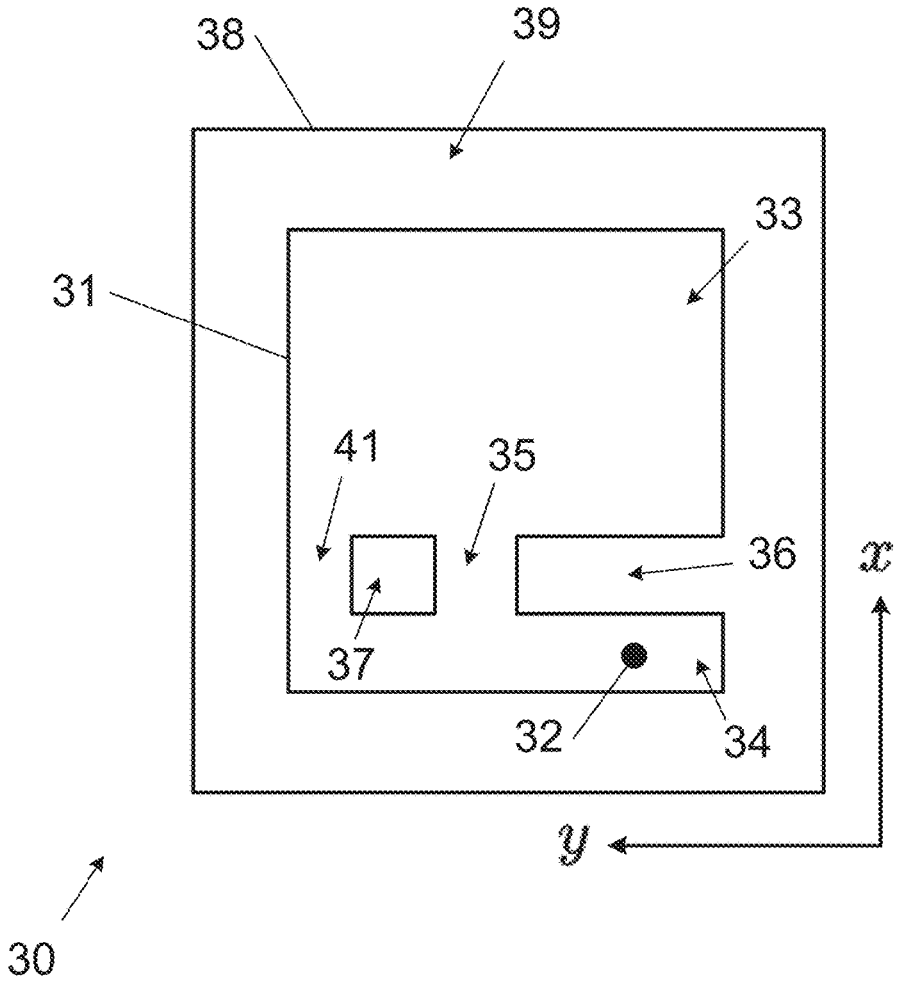
FIG. 3 is a top side view diagram illustrating a left-hand circularly polarized (LHCP) patch antenna for in accordance with an embodiment of the invention.

A top side view of a LHCP patch antenna in accordance with an embodiment of the invention is illustrated in FIG. 3. Similar to the RHCP patch antenna discussed above, the LHCP antenna 30 includes a patch plate 31 that is located a distance above a metal ground plane 38. The patch plate 31 can include a first plate 34, a second plate 33, and two connecting bars 35, 41 joining the first and second plates. In operation, the first plate 34, the second plate 33, and the connecting bars 35, 41 can be tuned to resonate at the desired frequency. In many embodiments, the patch plate 31 can be a single piece of conductive metal chosen from metals that are known to one of ordinary skill in the art. Further, the patch plate 31 can be suspended above an air substrate, or may be patterned onto a top substrate 39 as discussed above. In various embodiments, the connection of the first and second plates expose first 37 and second slots 36 where the length of the second slot 36 can be greater than the length of the first slot 37. As illustrated, the first and second slots can each have pairs of sides of equal length. As discussed above, the inner conductor of a coaxial probe feed 32 can be connected to the first plate 34. Although specific CP patch antennas utilizing a single probe feed are discussed above with respect to FIGS. 1-3, any of a variety of CP patch antennas with a single probe feed as appropriate to the requirement of a specific application can be utilized in accordance with embodiments of the invention. Patch antenna design considerations in accordance with embodiments of the invention are discussed further below.

Patch Antenna Design Considerations

Patch antennas in accordance with embodiments of the invention can achieve impedance and axial ratio (AR) bandwidths which are difficult to realize with traditional single probe patch designs. In various embodiments, the patch antenna's performance allows for miniaturization compared to traditional designs allowing for a low-profile compact circular polarized single probe radiator. Depending on the design parameters, the patch antenna can be optimized by changing the geometry of the patch plate and patch antenna implementation. In many embodiments, Particle Swarm Optimization, a global optimization engine whose operations mimic the feeding and searching habits of bees, can be utilized to test and design patch plate geometries. Further, by properly sizing the first plate and its connecting bars of the patch plate, large probe reactance can be compensated.

Figure 4:
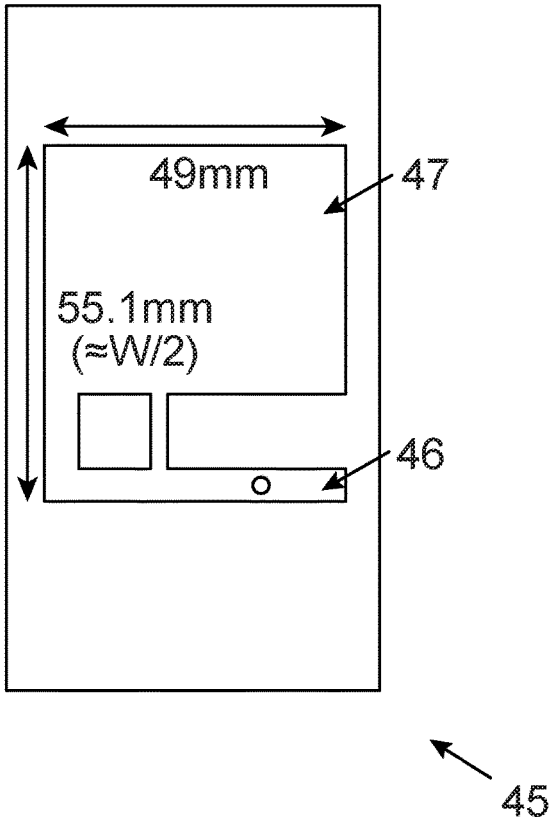
FIG. 4 is a top side view of a patch plate design for an LHCP patch antenna in accordance with an embodiment of the invention.

A top side view of a patch plate design for obtaining left-hand circular polarization in accordance with an embodiment of the invention is illustrated in FIG. 4. The patch plate 45 includes a first plate 46 and a second plate 47. As the measurements in FIG. 4 illustrate, the patch plate 45 is not square but has one side that is 49 mm long and another side that is 55.1 mm. In this patch plate design, the 55.1 mm is nearly one-half the wavelength of the desired radiation. In many embodiments, various radiation wavelengths can be achieved by changing the design of the patch plate.

Figure 5:
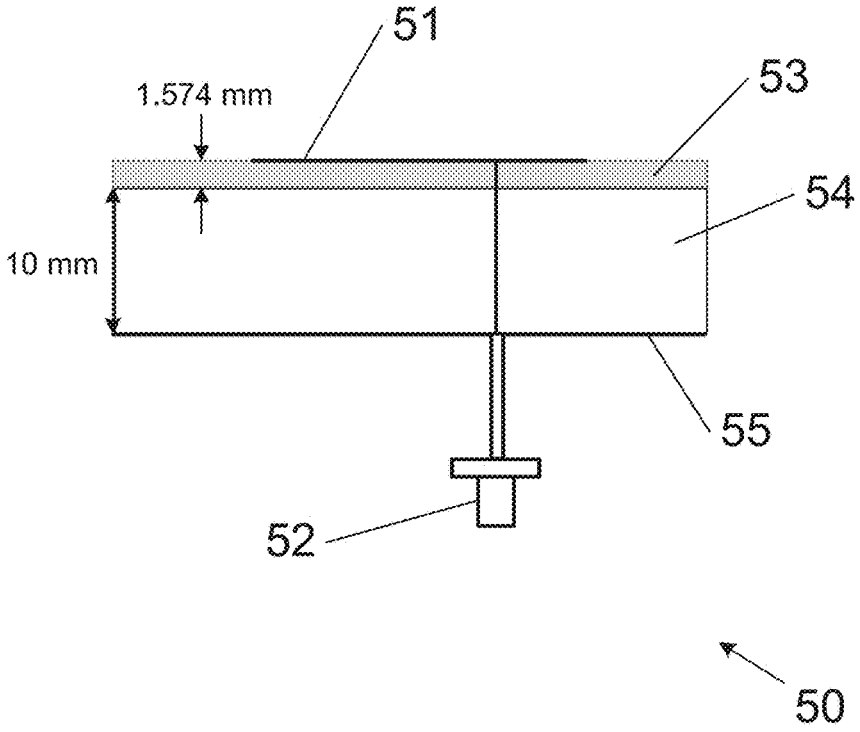
FIG. 5 is a profile side view of a layer stack-up implementation for a patch antenna in accordance with an embodiment of the invention.

A profile side view of a layer stack-up implementation for a patch antenna in accordance with an embodiment of the invention is illustrated in FIG. 5. The patch antenna 50 includes a patch plate 51 and a ground plane 55. In several embodiments, the probe feed 52 can be a variety of resistance including (but not limited to) 50 Ohm. In many embodiments, a dielectric substrate 53 such as (but not limited to) a high frequency laminate substrate produced by the Rogers Corporation (i.e. the Rogers Duroid 5880) can be utilized. In various embodiments, a foam layer 54 can be implemented between the dielectric substrate 53 and the ground plane 55. As illustrated, the dielectric substrate 53 can be 1.574 mm thick and the foam layer 54 can be 10 mm thick. Although specific patch antenna designs are discussed above with respect to FIGS. 4-5, any of a variety of designs having a variety of patch plate designs and antenna implementations as appropriate to the requirement of a specific application can be utilized in accordance with embodiments of the invention. Patch antenna performance characteristics in accordance with embodiments of the invention are discussed further below.

Patch Antenna Performance Characteristics

Patch antennas in accordance with embodiments of the invention were able to achieve a fairly broad bandwidth of 2.4-2.53 GHz (roughly 5.3%) satisfying both AR≤3 dB and S11≤−10 dB simultaneously for a height of roughly λ/10. As discussed above, patch antennas in accordance with embodiments of the invention are circularly-polarized, low-profile, compact, broadband, and ideal for applications in satellite communications products that require circular polarization supporting multiple or broadband wireless standards. Further, the patch antennas can be particularly applicable to implementation to linear arrays or even planar arrays for high gain applications.

Figure 6:
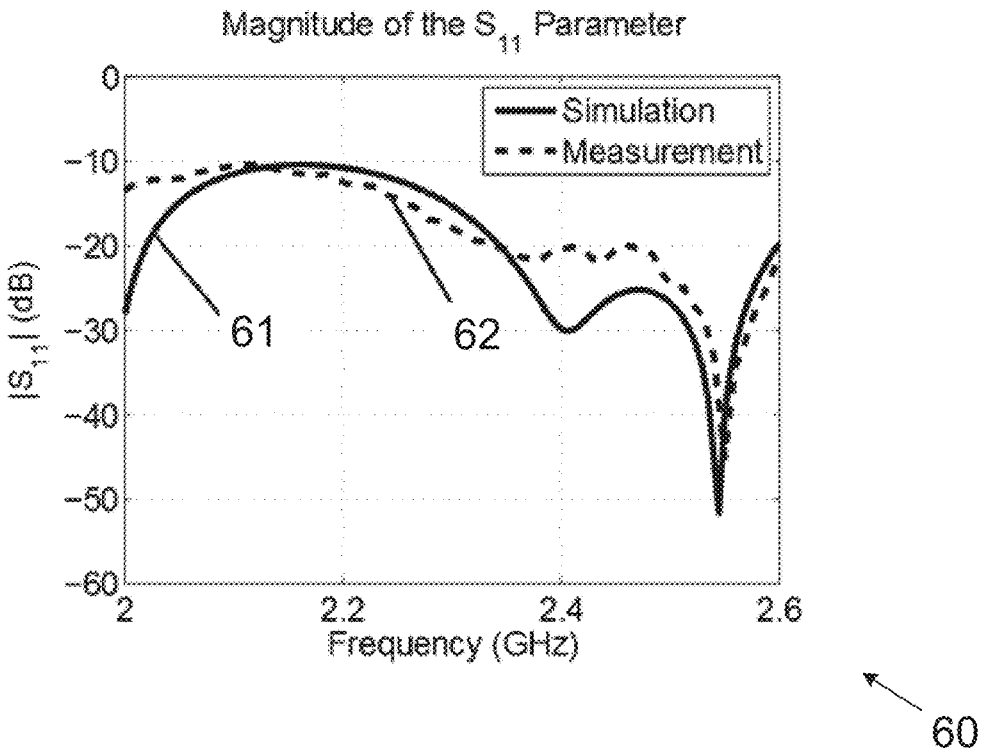
FIG. 6 is a graph illustrating impedance matching characteristic as a function of frequency in accordance with an embodiment of the invention.
Figure 7:
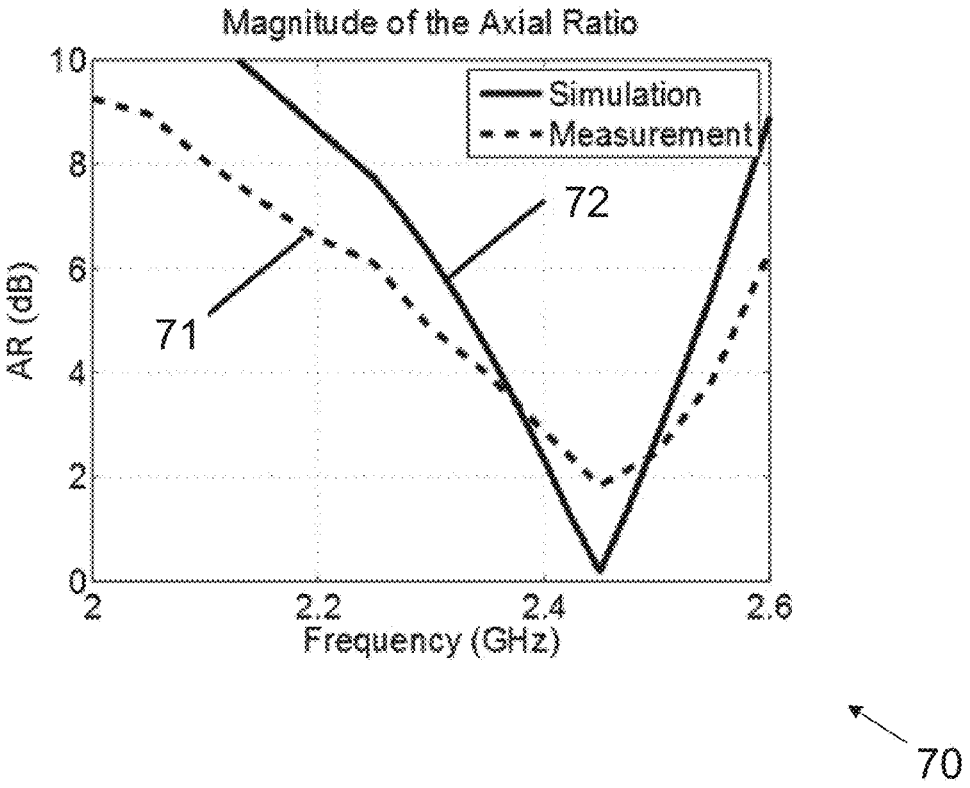
FIG. 7 is a graph illustrating axial ratio (AR) characteristics towards broadside (Theta=0) as a function of frequency in accordance with an embodiment of the invention.

A graph illustrating impedance matching characteristics of a patch antenna as a function of frequency in accordance with an embodiment of the invention is illustrated in FIG. 6. The graph 60 includes the magnitude of the S11 parameter in a 2-2.6 GHz range for a simulation 61 and measured 62 results. The simulated and measured results 61 and 62, respectively, are comparable. Overall performance is quite remarkable, where a return loss greater than 10 dB is achieved over a 35% fractional bandwidth. A graph illustrating AR characteristics towards broadside (Theta=0) of a patch antenna as a function of frequency in accordance with an embodiment of the invention is illustrated in FIG. 7. The graph 70 includes the magnitude of the AR in a 2-2.6 GHz range for a simulation 71 and measured 72 results. The simulated and measured results 71 and 72, respectively, are comparable. An AR less than 3 dB is achieved over a 5.3% bandwidth.

Figure 8A:
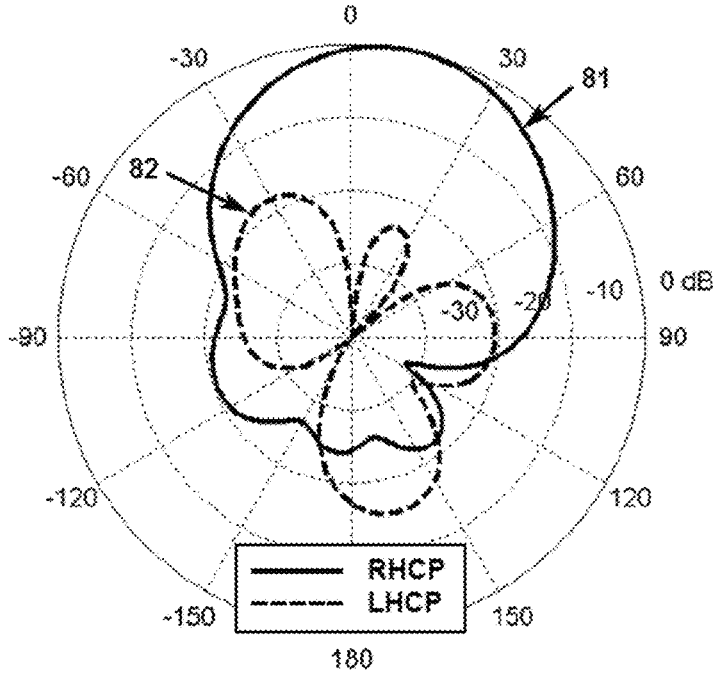
FIG. 8A is a plot illustrating radiation patterns of patch antennas in the XZ plane in accordance with an embodiment of the invention.
Figure 8B:
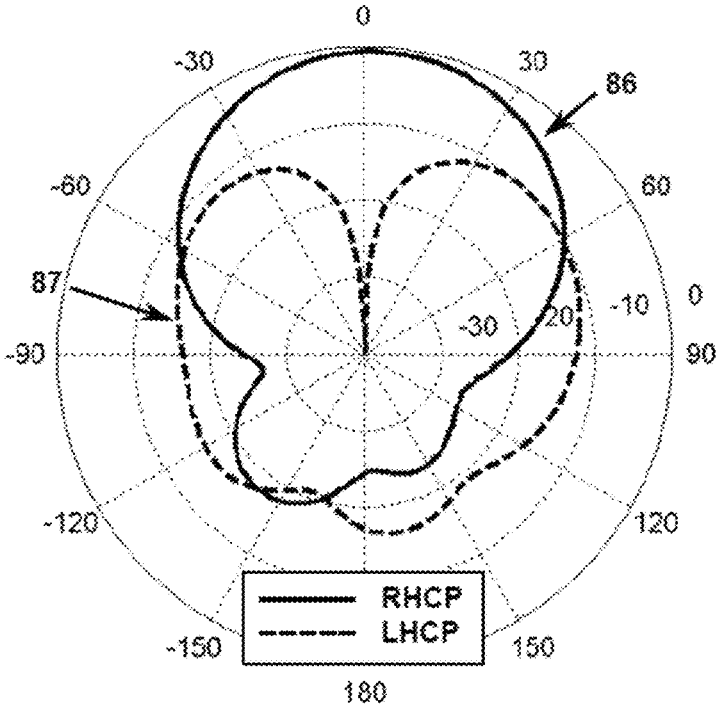
FIG. 8B is a plot illustrating radiation patterns of patch antennas in the YZ plane in accordance with an embodiment of the invention.

A plot illustrating radiation patterns of patch antennas in the XZ plane in accordance with an embodiment of the invention is illustrated in FIG. 8A. The plot 80 shows the radiation pattern in a phi cut of 0 degrees (XZ Plane) at 2.45 GHz for RHCP 81 and LHCP 82 results. A plot illustrating radiation patterns of patch antennas in the YZ plane in accordance with an embodiment of the invention is illustrated in FIG. 8B. The plot 85 shows the radiation pattern in a phi cut of 90 degrees (YZ Plane) at 2.45 GHz for RHCP 86 and LHCP 87 results. The radiation patterns are typical of a patch antenna and is unidirectional towards broadside, i.e. theta=0 degrees. Although specific performance characteristics of patch antennas are discussed above with respect to FIGS. 6-8B, any of a variety of performance characteristics as appropriate to the requirement of a specific application can be realized in accordance with embodiments of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A circularly polarized patch antenna, comprising:
- a ground plane;
- a patch plate comprising a first plate section and a second plate section where:
  - the first and second plate sections are connected via a first connecting bar and a second connecting bar; and
  - the connection between the first and second plate sections via the first and second connecting bars exposes a first slot and a second slot;
- at least one dielectric substrate that separates the ground plane and the patch plate;
- a feed probe that is a coaxial cable comprising an inner conductor and an outer conductor where the inner conductor is connected to the first plate section and the outer conductor is connected to the ground plane;
- wherein the broadband patch antenna is configured to radiate a circularly polarized radio frequency (RF) signal.

2. The broadband patch antenna of claim 1, wherein the second slot has a length that is longer than the length of the first slot.

3. The broadband patch antenna of claim 1, wherein the second connecting bar separates the first and second slots.

4. The broadband patch antenna of claim 3, wherein the first and second connecting bars are equal in shape.

5. The broadband patch antenna of claim 3, wherein the first and second connecting bars are not equal in shape.

6. The broadband patch antenna of claim 1, wherein the circularly polarized RF signal is left-hand polarized.

7. The broadband patch antenna of claim 1, wherein the circularly polarized RF signal is right-hand polarized.

8. The broadband patch antenna of claim 1, wherein the at least one dielectric substrate is a foam substrate.

9. The broadband patch antenna of claim 1, wherein the at least one dielectric substrate is a substrate that enhances mechanical and electrical performance characteristics of the broadband patch antenna.

10. The broadband patch antenna of claim 1, wherein the circularly polarized RF signal is transmitted with a radiation pattern that is unidirectional towards broadside.

* * * * *